United States Patent [19]

Goldstein et al.

[11] Patent Number: 4,893,106

[45] Date of Patent: Jan. 9, 1990

[54] ELECTRICAL FUSES

[75] Inventors: Michel Goldstein, Randolph Township, N.J.; Kenneth D. Howton, Palatine; Larry L. Jones, Bartlett, both of Ill.

[73] Assignee: Brush Fuses Inc., Chicago, Ill.

[21] Appl. No.: 287,111

[22] Filed: Dec. 21, 1988

Related U.S. Application Data

[63] Continuation-in-part of Ser. No. 169,313, Mar. 17, 1988.

[51] Int. Cl.[4] ..... H01H 85/04; H01H 85/38

[52] U.S. Cl. ..... 337/159; 337/273; 337/276; 337/280; 337/295

[58] Field of Search ..... 337/159, 158, 160, 161, 337/162, 295, 296, 290, 276, 280, 273, 277

[56] References Cited

U.S. PATENT DOCUMENTS

| | | | |
|---|---|---|---|
| 1,016,524 | 2/1912 | Sachs | 337/290 |
| 2,018,556 | 10/1933 | Hope | 200/131 |
| 2,041,590 | 5/1936 | Brown | 337/166 |
| 2,223,959 | 12/1940 | Lohausen | 337/158 |
| 2,337,504 | 12/1943 | Strom | 337/158 |
| 2,502,747 | 4/1950 | Popp | 337/163 |
| 2,734,111 | 2/1956 | Kozacka | 337/161 |
| 2,761,932 | 9/1956 | Kozacka et al. | 337/159 |
| 2,777,033 | 1/1957 | Kozacka | 337/159 |
| 2,781,434 | 2/1957 | Swain | 337/159 |
| 3,118,992 | 1/1964 | Chabala | 337/158 |
| 3,227,844 | 1/1966 | Burrage et al. | 337/158 |
| 3,261,952 | 7/1966 | Kozacka | 337/159 |
| 3,317,691 | 5/1967 | Bassani | 337/159 |
| 3,341,674 | 9/1967 | Jacobs, Jr. | 337/276 |
| 3,417,357 | 12/1968 | Withers | 337/295 |
| 4,017,817 | 4/1977 | Ranzanigo | 337/159 |
| 4,041,434 | 8/1977 | Jacobs, Jr. | 337/158 |
| 4,041,435 | 8/1977 | Gaia | 337/295 |
| 4,053,860 | 10/1977 | Kozacka et al. | 337/295 |
| 4,118,684 | 10/1978 | Mollenhoff | 337/295 |
| 4,272,752 | 6/1981 | Jacobs | 337/276 |
| 4,323,872 | 4/1982 | Fontaine | 337/158 |
| 4,511,874 | 4/1985 | Rasmussen | 337/159 |
| 4,736,181 | 4/1988 | Dornauer | 337/203 |

*Primary Examiner*—H. Broome

[57] ABSTRACT

The disclosed full-range fuse provides excellent short-circuit and overload protection using various forms of fuse links, made of copper or copper alloys, or silver, including curtain fuse links, the short-circuit performance being enhanced by solidifying the sand or other granular fill with a binder, notably a silicate or boric acid, the overload interruption being enhanced by boric acid that is distributed throughout the fill.

23 Claims, 1 Drawing Sheet

FIG. I
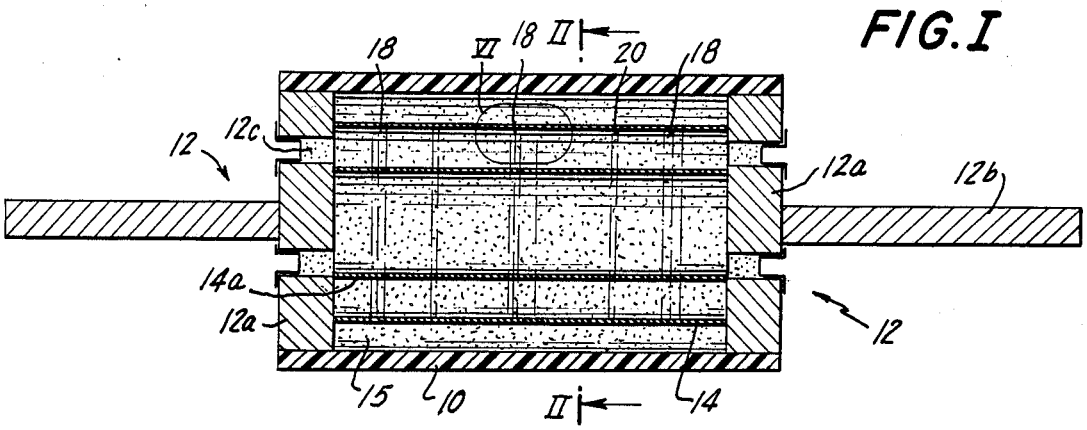
FIG. II
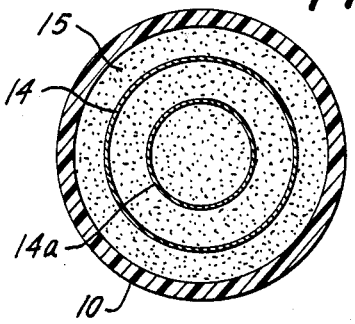
FIG. VII
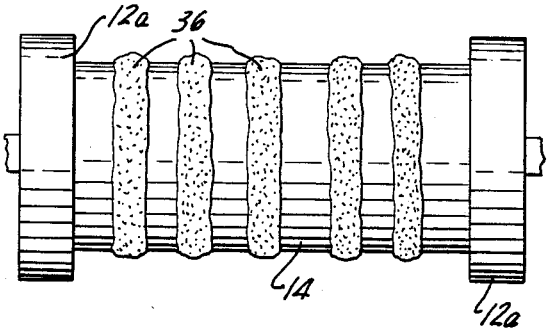
FIG. III
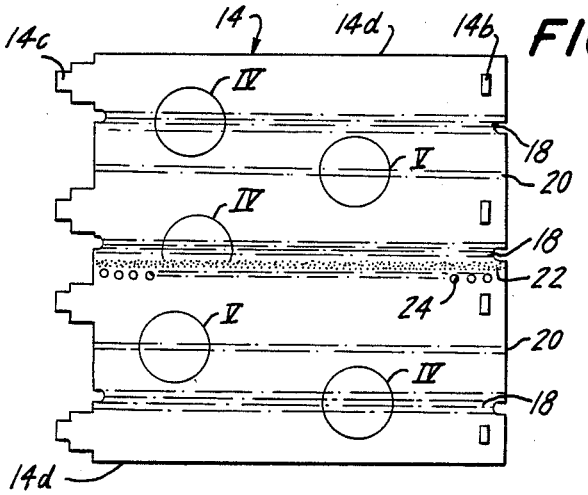
FIG. VI
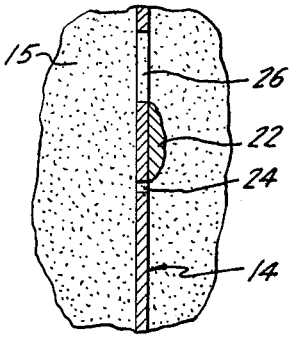
FIG. IV
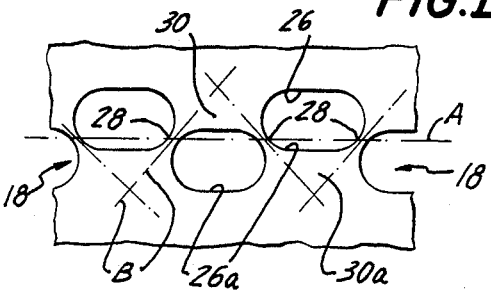
FIG. V
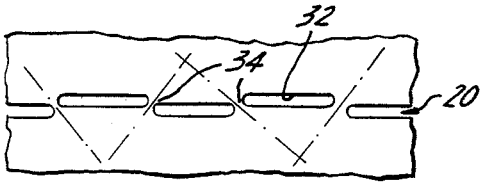

ELECTRICAL FUSES

This application is a continuation-in-part of 07/169,313 filed 3/17/88.

The present invention relates to electrical fuses, particularly full range fuses.

Fuses of two types have long been available for providing protection against both short circuits and overloads, i.e., persistent over currents. "Dual element" fuses are one type that provide such protection; they are really two fuses in one unit, a short-circuit interrupter and a time-delay overload interrupter in series. The cost of manufacturing such fuses is inherently high, and they are very bulky. "Full range" fuses are another type of fuse that provides for clearing both short-circuits and overloads; they can clear any current that causes the fuse link to open when operated at rated voltage or lower. That current may be a short-circuit or a sustained overcurrent, or it may even be rated current or less when the fuse is operated at abnormally high ambient temperature. Typically, full-range fuses include a tube of insulation, end terminals, a fusible link between the terminals and an arc-quenching filler, usually sand. While dual element fuses and full range fuses are both designed for interrupting short-circuits and overloads, the performance standards applicable to the two fuse types are different in various respects.

Full range fuses of various classes are required to have high interrupting capacity, for use in circuits where high short-circuit current is available, such as 100k Amps or 200k Amps. Such full range fuses are generally of the "silver-sand" construction, having fuse links of silver in packed sand. The high cost of silver links in full range fuses represents a long-standing concern. Sheet silver costs about 12 times as much as sheet copper, so use of copper, copper alloy or other fuse links is an attractive alternative. However, copper fuse elements seem to be unknown commercially in so-called high performance fuses where low peak let-through currents and clearing energy are a criterion.

The term "fuse link" as used here refers to the fusible connection between the fuse terminals. A fuse link in this sense may consist of one fuse element, in fuses of low ampere ratings; or the fuse link may consist of multiple fuse elements in parallel for fuses of high ampere ratings. The term "fuse element" is used here to refer to a discrete fusible conductor, usually a strip, providing a current path between the fuse terminals.

In a full range fuse, the fuse element (or each of multiple parallel fuse elements) typically has plural interruption segments spaced apart along its length.

Most of the interruption segments of a fuse element for a full-range fuse are designed for clearing short-circuits. At least one interruption segment is responsive to overloads. An overload interruption segment may serve in both capacities, for interrupting short-circuits and for interrupting overloads.

The overload interruption segment of a fuse element in a full-range fuse may be formed in various ways. The common form of overload segment relies on the "m-effect" wherein the fuse element is narrowed locally to form a neck or multiple parallel necks, and the fuse element bears low-melting metal at or near the neck(s). The low-melting metal melts and flows when an overload occurs and it becomes alloyed with each neck; and the resistivity of the neck then rises and causes intensified heating, alloying, melting and parting of the neck, for interrupting the overload. Other ways are known for providing overload interrupting segments.

In full range fuses for high current ratings, each fuse link usually comprises many parallel-connected strips of silver. The silver of those links represents a major cost factor in the manufacture of such fuses. In addition, high costs are inherent in making the many separate fuse strips and in making the many connections of the fuse strips to the fuse terminals. Moreover, the fuse strips are fragile so that great care is required during manufacture of fuses having a fuse link of many strips.

What is here called a "curtain" fuse element can carry the high rated current of fuses having many parallel-connected fuse elements. A "curtain" fuse element is a sheet of metal having a number of interruption segments in series; each interruption segment extends across the curtain fuse element and each interruption segment has a large number of necks in parallel. The distinction between an ordinary fuse element and a curtain fuse element may not always be clear. An ordinary fuse element may have a single neck or a few necks in each interruption segment; in a curtain fuse element, the number of necks in an interruption segment is large. The curtain fuse element can have excellent short-circuit interrupting performance, but curtain fuse elements characteristically provide poorer overload performance than a fuse having a fuse link of many parallel strips. Even though the curtain fuse element is well known, many strips in parallel are customary in full range fuses having high rated current.

A curtain fuse element formed as a sheet-metal cylinder is known; such a fuse element forms a mechanically sturdy unit in contrast to many separate fusible strips that are fragile and must be handled carefully in assembling a fuse. Moreover, in contrast to fuses having many parallel-connected fuse strips that are difficult to locate at definite positions in the arc-quenching space, the cylindrical form of curtain fuse element inherently determines the positions in the fuse of all of its necks. However, even though cylindrical curtain fuse elements are known, the use of many parallel-connected strips persists in full-range fuses. Use of curtain fuse elements in full-range fuses seems unknown commercially.

The short-circuit interrupting performance of silver-sand fuses has heretofore been improved by including a binder with the sand, specifically a silicate binder. Such fuses provide excellent short-circuit protection. However, adding a silicate binder to the sand of a full-range fuse impairs or nullifies its overload interrupting capacity.

The present invention represents an important advance in the art of fuses, an art characterized by slight gains introduced sporadically over many decades.

In one respect, the present invention promotes successful use of curtain fuse elements, especially cylindrical curtain fuse elements, in full range fuses.

In a further respect, the present invention provides such enhanced performance of copper and copper alloy fuse elements that they can be used where silver fuse elements were required heretofore.

In another respect, this invention provides greatly improved performance of silver link fuses.

In yet another respect, the invention provides novel fuses having improved overload characteristics.

The invention provides novel fuses containing copper, copper alloy, or silver links having improved full range performance, even fuses having curtain-fuse links of those metals. In particular, novel fuses are provided having cylindrical curtain links of copper having characteristics that have been met heretofore only in fuses having many parallel-connected elements of silver.

The foregoing improved fuse performance, in turn, enables production of relatively low-cost fuses, in terms of reduced cost of labor and material, in place of fuses having a large number of parallel fuse elements of silver.

Silver-sand fuses can similarly be provided having improved short-circuit performance resulting from inclusion of a silicate binder with the sand filler and which have excellent overload performance despite harmful effects of the silicate binder on overload. Moreover, full-range fuses may be provided having silver curtain fuse elements, even silver cylindrical curtain fuse elements.

The illustrative fuses described in detail below and shown in the drawings include sand packed around a fuse element haying an overload interruption segment, and boric acid is distributed uniformly throughout. The filler in the superior illustrative fuses includes sand and a binder; the sand alone is tightly packed in the enclosure and against the fuse element(s), and the binder unites the sand and forms a matrix having voids, the voids containing boric acid. The matrix of the packed sand and a silicate binder is impregnated with a fluid comprising boric acid and water or a non-aqueous vehicle and the excess water or other vehicle is removed, as in a kiln. In alternative improved fuses, the silicate binder is omitted, and then the packed sand is unified by the boric acid that acts as a binder. The boric acid may be present in various forms, including metaboric, orthoboric and the anhydrous oxide.

At short-circuit, the metal of the necks in all of the short-circuit interruption segments goes virtually from its solid state to vapor, arcs are formed where the necks existed, and small arc chambers are formed, bounded by molten sand. The binder evidently confines the arc gases so that increased plasma pressure develops, creating an arc-suppressing voltage. For this reason and because of increased current density in the necks of the fuse link, the let-through peak current and energy are reduced.

When an overload occurs, the necks at the overload segment of the fuse link melt. Boric acid is present at the melted necks. It is believed that the boric acid serves as a flux, inducing the molten metal of each neck to flow, hastening the parting of each neck to create an arc, then inducing the molten metal to migrate into the sand matrix; and that the boric acid gives up any bound water content when exposed to the heat of the arc, thereby cooling the arc and promoting arc extinction; and finally, that the thus dehydrated boric acid provides electrical insulation that aids in interrupting the current.

In the illustrative fuses described below and shown in the accompanying drawings, certain fuse elements—specifically cylindrical curtain fuse elements—have a series of distinctive current interruption segments. A row of parallel-connected necks extends across the current path. In a cylindrical fuse link, the row of necks encircles the link. The necks are the metal separating the holes. Each hole is offset from the next relative to an imaginary line across the current path. Moreover, the holes are of such form that each neck slants in relation to that imaginary line; and the successive necks slant oppositely so that successive pairs of necks diverge in opposite directions in the illustrative example. Arcs develop at the necks formed by the successively offset holes. The arcs collectively cause a narrow ring of fulgurites to form around the cylindrical fuse element, providing benefits noted below.

Multiple short-circuit interruption segments are in series between the ends of the fuse element, formed by holes as described above. However, the holes of different segments define relatively fast-melting necks and slower-melting necks. Consequently, the interruption current wave shows sharp limitation of the peak let-through current and a dull peak of the arc voltage, avoiding large and sudden peaks such as could damage insulation of apparatus in the protected circuit.

The nature of the invention including the novel aspects and features above, and others, will be apparent from a review of the following detailed description of an illustrative embodiment of the invention in its various aspects. That illustrative embodiment is shown in the accompanying drawings.

BRIEF DESCRIPTION OF THE DRAWINGS

FIG. I is a longitudinal cross-section of a cartridge fuse embodying features of the invention;

FIG. II is cross-section of the fuse of FIG. I at the plane II—II therein;

FIG. III is a fuse element of the fuse of FIGS. I and II as a flat sheet before being formed as a cylinder;

FIG. IV and V are greatly enlarged fragments of the fuse element of FIG. III at the areas typified by the circles designated IV and V in FIG. III;

FIG. VI is a greatly enlarged detail of the fuse of FIGS. I and II represented by oval VI in FIG. I; and FIG. VII is a view of a fuse as in FIGS. I and II following a short-circuit test, the tube of insulation and filler material being removed to show a fuse element and fulgurite formations produced in the test.

Referring now to the drawings, the fuse in FIGS. I and II includes an insulating tube 10, metal terminals 12 closing the ends of the tube, two cylindrical fuse elements 14 and 14*a*, and a filler 15 that fills all remaining space in tube 10. Use of a single cylindrical fuse element and use of more than two such elements are contemplated. Each terminal 12 includes a disc 12*a* and a blade 12*b*.

This fuse is fabricated by soldering or otherwise connecting the opposite-end edges of fuse elements 14 and 14*a* to discs 12*a*. Insulating tube 10 is assembled and fastened to discs 12*a*. All the space in the enclosure formed by tube 10 and discs 12*a* is filled and packed with sand according to conventional procedures including vibration. The packed sand retains voids throughout.

The term "sand" as used above means high purity quartz sand occurring in nature, but it is also used herein to include any other granular quartz of any suitable grain size. Other suitable inert granular materials may also be used.

Next, the sand is impregnated with an alkali-metal silicate, preferably sodium silicate (e.g. water glass having a suitable viscosity) for thoroughly filling the internal space. The surfaces of the grains of sand and the surfaces of the metal which forms the fuse element are wetted by the water glass. The excess water glass is drawn off, leaving voids throughout the fuse interior, and the fuse is then kiln-dried. The silicate forms a hard binder uniting the grains of sand. Various electrically acceptable binders may be used, such as colloidal silica. Fill/drain holes 12*c* are ultimately sealed.

Boric acid is next introduced. Boric acid is prepared in a near-saturated aqueous solution at elevated temperature for promoting high boric acid concentration. This solution is fluid and is inducted so as to fill the voids in the silicated sand. The fuse is again kiln-dried, so that free water is removed. The filler is then in a solidified and hard condition. The time and temperature of the kiln drying after impregnation with boric acid are limited for optimum performance. A substantial amount of the boric acid remains in the voids when processing is completed, the boric acid preferably containing water in its composition; it may comprise microscopic flakes in the voids. The filler ultimately comprises the sand that is tightly packed throughout, grain-to-grain and against the surfaces of the fuse elements; and both the binder and the boric acid are distributed separate throughout the resulting porous hard matrix. The voids of the filler are only partly filled by the dried boric acid.

Fuse element 14 is shown in FIG. III in its flat condition before being shaped as a cylinder. Element 14 is of copper in a fuse construction that is preferred as being economical and as being eminently successful in meeting industry standards. Fuse elements 14 of copper alloys and other base metals can also be used economically in fuses prepared as described, with excellent performance; and fuses using silver fuse elements having packed sand provided with a binder and permeated with boric acid, have considerably better performance than conventional silver-sand fuses of the same current and voltage ratings. With variations in proportions, this form of construction is suitable for various types of fuses.

In FIG. III, fuse element 14 includes a row of slots **14*b* and a row of tabs 14*c*. The fuse element is shaped as a cylinder and tabs 14*c* are threaded through slots 14*b* and then bent over, being one way of forming a cylindrical fuse element. The longitudinal edges 14*d* become the ends of the cylinder that are ultimately fixed to discs 12*a* as by solder. The length of edges 14*d* determines the circumference of the fuse element, and varies in accordance with the rated. current that the fuse element is to carry from one edge 14*d* to the other. Fuse element 14*a* is of the same configuration, but its edges corresponding to edges 14*d* are shorter than those of fuse element 14. In its cylindrical form, fuse element 14 is relatively rugged, requiring less care when being handled and being secured to discs 12*a* than when many fragile fuse elements are used. The unified subassembly of discs 12*a* and fuse element 14*a* or elements 14 and 14*a*** is remarkably strong; completion of the fuse assembly does not require the extreme care needed for assembling a fuse having many parallel silver links.

Fuse element 14 as shown in FIG. III is designed for a 600-Volt A.C. full-range fuse, and accordingly it has five current-interruption segments. Three of these segments 18 are of the form shown in FIG. IV, so designated by the circles IV in FIG. III, and two more of these current interruption segments 20 are of the forms shown in FIG. V, so designated by the circles V in FIG. III. In addition, an overlay 22 of low-melting metal or alloy, tin in this example, extends as a band along the middle current-interruption segment 18. All five segments 18 and 20 are short-circuit interruption segments. By virtue of low-melting band 22, the middle segment also serves as an overload current-interruption segment. A row of holes 24 is provided at the side of band 22 opposite the current-interruption segment 18. When an overload current of 135% (or higher) of the fuse's current rating persists, tin band 22 melts and the tin flows upward and alloys with the necks of middle segment 18. Holes 24 form one means for restraining reverse flow of the tin.

The formation that constitutes each short-circuit inter segment 18 is shown greatly enlarged in FIG. IV. Holes 26 are elongated and have sides **26*a* that are disposed alternately at opposite sides of an imaginary line A that extends across the fuse element, i.e., across the general direction of the current path from one edge 14*d* to the other. The ends of holes 26 are semicircles, and they include arcs disposed opposite to arcs of the next-adjacent holes and thus form narrow necks 28**.

A solid area 30 of the sheet metal extends from the large surface of element 14 to two necks 28, and another solid area **30*a* also extends the large solid area of element 14 to two necks 28. Accordingly, each neck extends from one area 30 to the other 30*a*. Heat that develops in necks 28 during normal conditions is dissipated both by conduction to areas 30, 30*a* and to the large imperforate areas of fuse element 14 and by transfer to the filler 15 that directly engages necks 28 and areas 30, 30*a* and the broad imperforate areas of fuse element 14. Each neck 28 extends along a line B that slants relative to imaginary line A. When necks 28 are fused and become gaps at the start of the current-interruption process, arcs form along lines that slant in relation to the general direction of the current path from one edge 14*d* to the opposite edge 14*d*. The direction of the slant reverses alternately from one neck/arc to the next, i.e., each successive pair of necks/arcs diverge relative to the length (current path) of the fuse element between the edges 14*d* at the ends of fuse element 14**.

FIG. V is a greatly enlarged detail of current-interruption segment 20. The relationships of the holes 32 and the necks 34 in FIG. IV are the same as is described above in relation to FIG. IV with exceptions resulting from the differences between holes 26 and 32. The lengths of holes 26 and 32 are approximately equal in this example. Holes 32 are much narrower than holes 26 so that necks 34 are formed by accurate edges of much shorter radius than necks 28. Necks 34 are shorter than necks 28, so that there is a shorter heat-conduction distance between the center of neck 34 and the adjoining large het-dissipating areas of fuse element 14 than is true of necks 28. In common with the interruption segment 18, the interruption segment 20 has alternately oppositely slanted necks; the necks of each successive pair diverge; and the arcs that develop as the necks fuse extend at alternating angles relative to the length of the fuse.

The production of curtain fuses with a large number of necks in each interruption segment is facilitated by the hole pattern described above. To less advantage, the holes may be shaped differently and placed differently in relation to one another so that the necks would not slant, or so that each neck and the next would not diverge oppositely. However, the diverging necks and the arcs that they initiate are instrumental in the development of the uniform narrow fulgurites 36 represented in FIG. VII and discussed further below.

The cylindrical fuse element provides necks that can be distributed ideally in various mutually spaced-apart volumes of the filler, so that they are ideally suited to efficient utilization of the cooling effects of the filler. Additionally, larger numbers of necks can be provided at each interruption segment of a cylindrical fuse element than can be provided in practice when separate parallel-connected fuse strips are used. There are practical difficulties in locating separate strips of a fuse at spaced-apart locations, so that the number of necks that can be used to divide the rated current of a fuse is limited. Consequently, the cylindrical fuse element makes practical a relatively large number of necks that are spaced apart for effective cooling. In turn, each neck can be made thinner, to carry normally a higher current density because of its efficient cooling. Higher current density in a neck signified a reduced amount of metal to be melted during short-circuit, reducing the peak let-through current and clearing $I^2t$.

The ratio of the neck-to-neck separation to the width of each neck is large here, 15:1 in an example, and sustains high normal current density. Other high ratios are quite effective, e.g. 13:1 to 20:1. The fuse shown in the drawings (omitting fuse element 14*a*) using a link 14 of copper, passes short-circuit test within established limits of $I^2t$. Where link 14 is made of silver, a superior fuse is attainable, i.e., it has much lower let-through current at short-circuit.

Available cartridge fuses provide full range performance using a filler of densely packed sand. As a full-range fuse, it clears the circuit both at short-circuit and on overload. Fuses have been available in which the sand is unified by a silicate binder, with considerable improvement in reduced $I^2t$ on short-circuit. However, the silication impairs response on overload. Full range fuses as described above have the superior short-circuit performance imparted by the binder, and the short-circuit performance is enhanced by increased current density in the necks of the fuse elements, these fuses also meeting overload interruption requirements. Homogeneous distribution of the boric acid in the silicated sand provides assurance that the desired constituents are available at the sites of the arcs that develop during overload interruption.

The internal parts of a fuse as in FIG. I, omitting element 14*a*, are shown in FIG. VIII in the condition existing after short-circuit. Uniform narrow rings of fulgurite 36 are notable, showing that very little burn-back occurred. This is evidence of a sharp limitation on the amount of energy dissipated in the fuse in clearing the short-circuit, even where the fuse element was of copper that ordinarily causes higher let-through peak current and energy than with the same fuse having a silver element. Substantial space was left between the fulgurites, indicating that the illustrative fuse was much longer than necessary. For this reason, it is practical to produce shorter fuse links and correspondingly shorter complete fuses compared to available fuses of equal ratings.

A full range fuse having a curtain fuse link in a filler as described has a remarkable appearance after an overload is cleared, in that a fulgurite is formed only at the overload interruption segment, and the single fulgurite is remarkably narrow. The other interruption segments 18 and 20 remain intact. Interruption of an overload in a conventional fuse involves a characteristically different process. A conventional fuse of like rating has many parallel-connected silver fuse strips in packed sand, each fuse strip having a series of necks distributed along its length for short-circuit interruption, plus an overload segment. In the process of clearing an overload in such a conventional fuse, all of the overload interruption segments of the parallel-connected fuse strips blow initially in extremely fast succession. Remarkably, most or all short-circuit interruption segments of the parallel-connected strips also blow as part of the overload interruption process. Gaps in the metal strips replace their interruption segments and fulgurites are formed. Clearing of an overload in that form of conventional fuse takes place according to a process of "commutation", with the fault current shifting from one link to another as gaps develop in the fuse links successively, followed by restriking of arcs at previously formed gaps and arc quenching, until the overload fault is totally cleared.

The offset or stepped of the holes that form the bridges of FIGS. IV and V, and the use of different-length bridges 28 and 34, are believed to be contributing factors in the narrowness of the fulgurites. A pattern of arcs develops that extends around the cylindrical fuse element produces narrow rings of fulgurite that are formed when a short circuit has been cleared. Long necks 28 melt and part first, then necks 34, these being of equal width at their midpoints. Together, interruption segments 18 and 20 act in quick succession, for producing reduced peak current and let-through $I^2t$.

Further consideration of the overload performance of the described fuse may be useful. A long persisting overload melts the necks of interruption section 18 which are adjacent to tin band 22. Boric acid is available throughout the packed sand and thus it is available at those necks. In the absence of boric acid, the overload performance of such a fuse is impaired by the silicate binder, but despite such impairment, and despite the poor overload performance of curtain fuses generally, the described fuse has excellent overload performance. It is considered that boric acid which is available at the melted necks has several salutory effects: that boric acid acts as a flux in promoting migration of the melted metal of the necks into the sand matrix and out of the current paths; that it promotes quenching of the arc, both by absorbing heat from the arc as the bound water is freed from the available boric acid by exposure to the high temperature of the arc, and by adding to the arc-extinguishing pressure of the plasma; that the boric acid is an effective insulator in the fulgurite even at the high arc temperatures, promoting interruption of the current.

Accordingly, excellent overload performance of the described fuse has been achieved despite various factors, noted above, that detract from its overload performance. The described fuse also has excellent short-circuit performance despite its copper fuse link which inherently tends to develop greater let-through current peaks and $I^2t$ than silver. For example, tests were performed on a high-performance fuse of the silver-sand type that had many parallel fuse elements and lacked a time delay provision. That fuse would typically have 45 kA peak let-through current in a test circuit having 100 kA available. When such a fuse has a time delay provision, the peak let-through current would typically be 60 . By comparison, a full range fuse of the same rating, made as described above having fuse elements 14 of copper and being curtain fuse links (two adverse factors) had only 42 kA peak let-through current. This fuse also met overload interruption standards and time delay provision.

In the fuse described above, the silicate binder retains the improved short-circuit interruption property of fuses (compared to fuses having a filler of only packed sand) and yet the deleterious effect of the silicate in interrupting overloads is corrected by the inclusion of boric acid in the voids of the sand-and-silicate matrix. In a modification which omits the silicate binder, full-range fuses are made having the structure described above and shown in the drawings, in which the filler consists of packed sand that is impregnated with boric acid and kiln-dried. The packed sand filler with its dried boric acid impregnant is a unified matrix, so that the boric acid acts as a binder in addition to its other properties that enhance arc interruption.

Comparative tests were performed on fuses of that construction (but omitting fuse member 14*a*), proportioned for a rating of 600 volts and 400 Amperes. Such fuses with various fills were tested for short-circuit and overload performance: fuse A having a fill of only packed sand; fuse B having a fill of packed sand impregnated only with boric acid and kiln-dried; and fuse C having a fill of packed sand impregnated first with sodium silicate as described and then with boric acid, the fuse being kiln-dried after each impregnation. The following are the test results with 100 kA of available current at short-circuit and with 800 A (twice rated current) as the overload current.

The overload clearing time of fuse A was 12 cycles whereas the clearing time of fuses B and C was less than one cycle. For ready comparison, the short-circuit data is best expressed as percentages of the data for fuse A. The peak currents of fuses B and C were 88% and 82%, respectively of the fuse A peak current. The clearing $I^2t$ of fuses A and C were 82% and 55%, respectively, of the fuse A clearing $I^2t$.

The peak let-through current of fuse A during short-circuit actually exceeded slightly the limit provided in the applicable standard of Underwriters Laboratory, thus representing a failure.

The test data shows fuse C to be a successful full range fuse notably superior to fuse A in both overload and short-circuit performance. However, fuse B also represents a distinct improvement in short-circuit performance when compared to fuse A with its fill of packed sand only.

The fill of fuse B is a hard matrix of packed sand, unified by the boric acid. The short-circuit test data for fuses A and B demonstrate effective contribution of the boric acid as a binder in the fill of fuse B. The peak let-through current and clearing $I^2t$ of fuse B are notably lower than the values of fuse A with its fill of only packed sand. Unlike fuse A, fuse B with its fill of packed sand and boric acid impregnation performed quite well in the 200% overload test.

The overload tests of fuses A, B and C at rated voltage produced impressive effects. In fuse B and C, the overload was cleared solely at the overload interruption segment. A gap of about ⅛ to ¼-inch wide developed in place of the overload interrupting segment of fuse member 14. The short-circuit interrupting segments of fuse member 14 remained intact. The overload test of fuse A produced very different results. The metal of fuse member 14 burned back so far that the gap produced by arcing was about 1½ nearly to the opposite-end terminals of the fuse, and the insulting tube of the fuse was exposed to damaging heat. Fuse A was nearly a failure in the overload test.

A fourth fuse of the same structural form as fuses A, B and C but having a fill of packed sand and a silicate binder might have been tested, but the test results would provide no new information. That fourth fuse would perform the same on short-circuit as fuse C, and it would not interrupt overloads, based on ample experience.

The advance in the art is dramatic; many distinctive results and benefits are realized. A full range fuse can now be made with copper, copper alloy and other low-cost fuse elements, where comparable full range fuses are currently available only with silver fuse links. The short-circuit performance of the above described full range fuse, and with the described sand-silicate-and-boric acid, even when made with a copper fuse link, is equal to or superior to that of currently available silver-sand full range fuses. Curtain fuse elements can be used in full range fuses of such high current ratings that many parallel-connected strips have been required heretofore and, more particularly, cylindrical curtain fuse elements can be used successfully as the link in full range fuses, even when the link is of copper or the like. Fuse links of silver and particularly curtain fuse links of silver, can be used in full range fuses whose overload performance is considerably improved. The form of fuse here shown and described represents a much more compact unit than full-range fuses in which a short-circuit section and a separate overload section are combined in one series unit. Significantly more compact full-range fuses of higher current ratings can be produced as detailed above compared with full-range fuses containing many parallel silver fuse links, in which each fuse link has a series of short-circuit interruption segments and an overload interruption segment.

Evidently many changes and varied application of the foregoing disclosure may be made by those skilled in the art. Consequently, the claims should be construed broadly, in accordance with the spirit of the invention.

What is claimed is:

1. A electrical fuse having an enclosure comprising an insulating tube and electrical terminals closing the ends of the tube, a fuse link in said enclosure interconnecting said terminals, and inert granular arc-quenching material which, alone, is tightly packed in said enclosure leaving voids throughout, and a binder unifying said granular material, said voids containing boric acid.

2. An electrical fuse having an enclosure comprising an insulating tube and electrical terminals closing the ends of said tube, a fuse link in said enclosure interconnecting said terminals, and a filler in said enclosure comprising inert granular arc-quenching material unified by a binder and leaving voids having boric acid therein.

3. An electrical fuse as in claims 1 or 2, made by a process wherein boric acid is introduced into said granular material a fluid and then dried.

4. An electrical fuse as in claims 1 or 2, made by a process wherein boric acid is introduced into said granular material as an aqueous solution and then dried.

5. An electrical fuse having an enclosure comprising an insulating tube and electrical terminals closing the ends of the tube, a fuse link in said enclosure interconnecting said terminals and comprising a series of current-interruption segments at successive locations between said terminals, said current interruption segments including multiple short-circuit interruption segments and an overload interruption segment, inert arc-quenching granular material which, alone, is tightly packed about said fuse link leaving voids therein, and a binder unifying said granular material, said voids being partially filled with boric acid.

6. An electrical fuse as in claim 5, wherein said fuse link comprises at least one cylindrical curtain fuse element disposed coaxially in said tube.

7. An electrical fuse as in claim. 5, wherein said fuse link includes at least one curtain fuse element of sheet copper or copper alloy.

8. An electrical fuse as in claim 5, wherein said inert granular material is sand.

9. An electrical fuse as in claim 5, wherein said binder comprises sodium silicate.

10. An electrical fuse as in claim 5, wherein said inert granular material is sand and wherein said binder comprises a silicate.

11. An electrical fuse as in claims 8 or 9, wherein said fuse link comprises at least one cylindrical curtain fuse element.

12. An electrical fuse as in claim 5, wherein said fuse link comprises at least one cylindrical curtain fuse element disposed coaxially in said tube, wherein said granular material is sand and wherein said binder comprises sodium silicate.

13. An electrical fuse as in claim 5 or claim 12 wherein said binder comprises said boric acid.

14. An electrical fuse as in claim 5 or claim 12 wherein said fuse element is copper or a copper alloy.

15. An electrical fuse as in claim 5 or claim 12 wherein said boric acid is introduced into said voids as a fluid impregnant and solidified by drying.

16. An electrical fuse as in claim 5 or claim 12 wherein said binder is a silicate that is introduced with a fluid vehicle into said voids and then dried, and wherein said boric acid is subsequently introduced into the voids with a fluid vehicle and is then solidified by drying.

17. An electrical fuse as in claims 1 or 2, wherein said fuse link comprises one or more fuse elements each of which has an overload interruption segment, the fuse being proportioned as a full-range fuse.

18. An electrical fuse as in any of claims 5, 6, 7 or 10 , proportioned as a full-range fuse.

19. An electrical fuse comprising a curtain fuse element having a long series of holes distributed across the fuse element so as to define collectively a current interruption segment, each hole having elongated side and having ends close to respective ends of next-adjacent hole of the series so as to define narrow necks between the successive holes of the series, each of said holes being offset and thus stepped in relation to .the next adjacent holes.

20. An electrical fuse as in claim 19 wherein said elongated sides of the successive holes alternate at opposite sides of an imaginary line crossing the fuse element.

21. An electrical fuse as in claim 19 wherein each end of each said hole is shaped as a convex arc so that the neck formed by arcs of next-adjacent holes extend slantwise relative to said imaginary line.

22. An electrical fuse as in claim 20 wherein each end of each hole is related to its next-adjacent holes so that the successive necks formed by the holes of the series slant oppositely relative to said imaginary line.

23. An electrical fuse as in any of claims 19, 20, 21 or 22 wherein said fuse element has a second current interruption segment formed by a long series of holes distributed across the fuse element so as to define collectively said second current interruption segment, each of the holes of said second interruption segment having edge portions close to edge portions of the next adjacent holes of the series to define narrow necks between such successive holes, and each hole of the second interruption segment being disposed in stepped relation to each of its said next-adjacent holes, said current interruption segments being spaced apart along the fuse element and proportioned so that the necks of one of said current interruption segments are faster-melting than the necks of another of said current-interruption segments.

* * * * *